US006450889B1

(12) United States Patent
Mendes, Jr.

(10) Patent No.: US 6,450,889 B1
(45) **Date of Patent: *Sep. 17, 2002**

(54) GAMING APPARATUS HAVING VARIABLE SPEED INDICATORS OF PROGRESS

(75) Inventor: John F. Mendes, Jr., Ormond Beach, FL (US)

(73) Assignee: Bob's Space Racers, Inc., Daytona Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/539,590

(22) Filed: Mar. 31, 2000

Related U.S. Application Data

(63) Continuation-in-part of application No. 09/506,678, filed on Feb. 17, 2000, now Pat. No. 6,257,585, which is a continuation of application No. 09/426,039, filed on Oct. 25, 1999, now abandoned.

(60) Provisional application No. 60/106,225, filed on Oct. 30, 1998.

(51) Int. Cl.[7] ..... A63F 9/14

(52) U.S. Cl. ..... 463/59; 273/442

(58) Field of Search ..... 273/441, 442, 273/445, 454, 459, 460; 463/58, 59, 60, 62, 63

(56) References Cited

U.S. PATENT DOCUMENTS

| | | | | | |
|---|---|---|---|---|---|
| 2,148,828 | A | * | 2/1939 | Myers | 273/442 X |
| 3,568,332 | A | * | 3/1971 | Koci et al. | 273/442 X |
| 3,657,457 | A | * | 4/1972 | Poynter | 273/442 X |
| 4,059,266 | A | * | 11/1977 | Nakamura | 273/442 |
| 4,335,878 | A | | 6/1982 | Nishimiya | 273/26 |
| 5,066,014 | A | | 11/1991 | Dobson | 273/110 |
| 5,407,212 | A | | 4/1995 | Dobson | 273/446 |
| 5,439,230 | A | * | 8/1995 | Mendes, Jr. | 273/349 |
| 5,480,148 | A | * | 1/1996 | Bartosik | 273/349 |
| 5,566,950 | A | | 10/1996 | Senna | 463/60 |
| 5,573,243 | A | | 11/1996 | Bartosik | 463/60 |
| 5,667,217 | A | | 9/1997 | Kelly et al. | 273/126 R |
| 5,669,607 | A | | 9/1997 | Silver et al. | 273/354 |
| 5,678,823 | A | | 10/1997 | Chaffee et al. | 273/371 |
| 5,954,338 | A | * | 9/1999 | Hampton | 273/349 |
| 6,306,041 | B1 | * | 10/2001 | Mendes, Jr. | 273/442 |

* cited by examiner

*Primary Examiner*—Raleigh W. Chiu
(74) *Attorney, Agent, or Firm*—Standley & Gilcrest LLP

(57) ABSTRACT

An arcade-style racing game is described. The game preferably includes one or more individual competition games that measure the fractional performance of a player, and an indicator of progress for each individual game. Each indicator of moves at a variable rate, the rate being determined by the fractional performance of a player in an associated game.

12 Claims, 8 Drawing Sheets

GAMING APPARATUS HAVING VARIABLE SPEED INDICATORS OF PROGRESS

This application is a continuation-in-part application of continuation-in-part application Ser. No. 09/506,678 filed Feb. 17, 2000, now U.S. Pat. No. 6,257,585, is a continuation of claiming priority to application Ser. No. 09/426,039 filed Oct. 25, 1999, now abandoned, which claims the benefit of U.S. Provisional Application No. 60/106,225, filed Oct. 30, 1998.

BACKGROUND AND SUMMARY OF THE INVENTION

The present invention relates generally to gaming apparatus useful in arcade-style games. In the past, arcade-style games have been simple in nature and directed primarily at children. In one such game, where the object is to maneuver a car-shaped game piece on a rotating surface, children are offered a chance to simulate driving, as they attempt to keep a car inside the boundaries of a track painted on a rotating surface. The child is then rewarded with points, tickets, or other indicia of success, the amount of which may depend upon how long the child is able to keep the car within the boundaries of the track. These games generally fall into two main categories: skill games and competition games. In a skill game, a player is generally pitted against a task, such as keeping a car within track boundaries or shooting at a target, and rewarded based upon the performance of that task. In a competition game, multiple players are primarily pitted against each other and rewarded based upon the relative performance of each player. The relative performance may be determined by simultaneous play or by competing against another player's score or performance.

Recently, commercial places of amusement such as restaurants with arcades and large game facilities have become more prevalent. These facilities may cater to adults as well as children, or perhaps primarily just adults. As such, there is a demand for games involving a higher level of skill. Presently, arcade-style games utilize switches or on/off sensors to determine success or failure. Some games use multiple sensors to account for different levels of success. In a competition game, where one player may be pitted against another player or several players, these switches or sensors are often used to move an indicator, such as a racecar or a toy horse, along a separate path or track towards a finish line or other predetermined destination. The indicator moves at a fixed speed when a switch or sensor is operated by the associated player, and does not move when a player is not operating that switch or sensor. There is presently, however, no technology for displaying and rewarding fractional success by moving the indicator at a variable speed that corresponds to the performance of the player.

It is therefore an object of the present invention to provide arcade-style competition games that provide a greater challenge and reward players more in accordance with their particular performance in a game by measuring the players' fractional success and displaying their relative performance accordingly.

The present invention includes gaming apparatus, gaming devices, and gaming systems. The present invention may also be used to upgrade or retrofit existing devices or apparatus, using methods and components described herein or known in the art.

A preferred embodiment of an arcade-style competition game of the present invention, in which one or more players seek to advance indicators of progress, comprises a plurality of individual competition games, wherein each individual competition game contains a player-controlled device. Each player-controlled device has an associated feedback device that is used to determine the performance of the player of that individual game. Indicators of progress, preferably one for each individual game, are also included in the competition game. Each indicator of progress is adapted to advance along a path toward a destination at a variable rate of speed. The rate of speed at which an indicator of progress advances is determined by the performance of one of the players in a respective individual competition game, as measured by the appropriate feedback device. A processor may be used to receive data from the feedback devices, make a determination of performance, and send appropriate signals to the indicators of progress. The game preferably ends when one of the indicators of progress reaches its respective predetermined destination.

Also included in the present invention is a racing competition game in which one or more players seek to advance indicators of progress. The competition game comprises a plurality of surfaces, each of the surfaces having a racing track depicted thereon. The game has a plurality of actuators, each actuator adapted to rotate a respective one of the surfaces about a respective central axis on command. A plurality of first feedback devices is included, each of the first feedback devices in communication with a respective actuator. Each first feedback device is adapted to determine the rotational position of a respective surface. The game also comprises a plurality of game pieces, each game piece positioned substantially adjacent to a respective surface. For each game piece, the competition game preferably has an associated steering mechanism. Each steering mechanism may then be adapted to move a respective game piece over a predetermined range of a respective surface.

The competition game also comprises a plurality of second feedback devices, each of the second feedback devices in communication with a respective steering mechanism and adapted to determine the lateral position of a respective game piece relative to a respective surface. A processor is used to receive data from the feedback devices and make a determination of performance. A plurality of indicators of progress is also included, each indicator of progress adapted to advance along a respective path on a secondary monitor at a variable rate. The variable rate at which an indicator moves is determined by the performance signal sent by the processor.

Although described with respect to motorized vehicle-inspired racing games, it is to be appreciated that the present invention may also be used in other arcade-style competition games, including but not limited to games based upon horse racing, airplanes, space ships, or other movable objects, water jets, air guns, and other game component firing or launching mechanisms. The present invention may also be used in other competition games, where the accuracy or skill of a player over a period of time may be determined in a relative sense by multiple skill regions, instead of a simple one-sensor, stop-or-go approach.

DETAILED DESCRIPTION OF PREFERRED EMBODIMENT(S)

The present invention is directed to an arcade-style competition game. The advantages of the present invention are applicable to any game where it may be desirable to measure and display the varying performance of competing players as the game progresses. The preferred embodiment is offered for example purposes, and it is to be recognized that other types of games may make use of the present invention. The invention monitors player performance and indicates player performance by varying the speed of an indicator's movement along a respective path while the game is being played.

Figure 1:
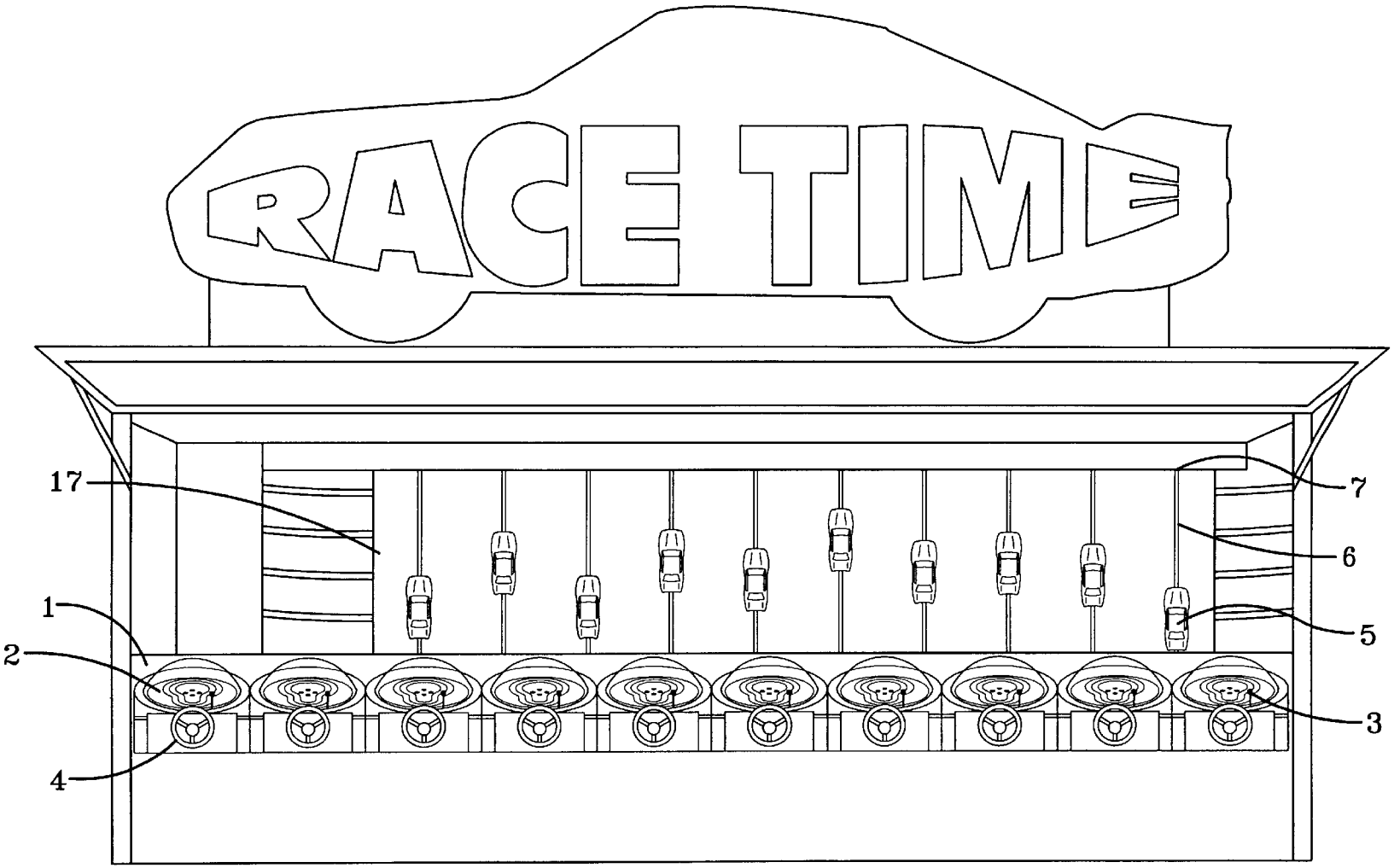
FIG. 1 is an elevational view of a preferred embodiment of a game of the present invention.
Figure 2:
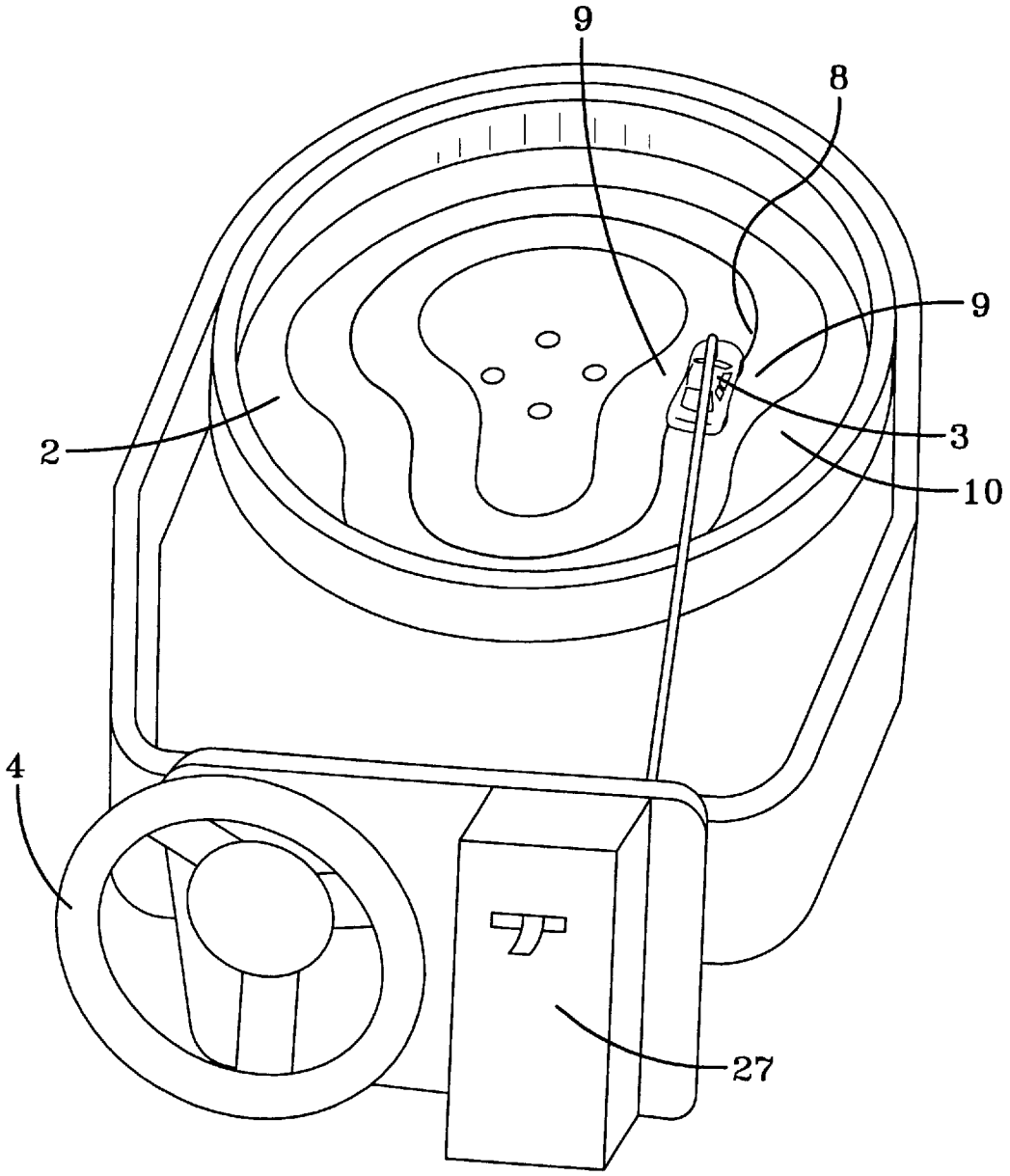
FIG. 2 is an elevational view of an individual game area contained in a preferred embodiment of a game of the present invention.

FIG. 1 shows a preferred embodiment of a game of the present invention. A preferred embodiment of a game of the present invention preferably includes a base structure 1 containing a series of individual racing games. An exploded view of an individual racing game is shown in FIG. 2, each individual racing game containing a surface 2, an actuator, a game piece 3, and a steering mechanism 4. A racing track is preferably depicted on each surface 2. Each actuator may be adapted to rotate an associated surface 2 about an axis on command. Each game piece 3 is preferably positioned substantially adjacent to the respective surface 2. Each steering mechanism 4 may be mechanically or electronically connected to the respective game piece 3, and it is preferably adapted to move or rotate the game piece 3 a predetermined range. With use of one of the steering mechanisms 4, a game player may position a respective game piece 3 substantially within the boundaries of the racing track as the surface 2 rotates about the axis.

FIG. 2 shows a central region 8 which preferably represents the highest skill level, two regions 9 adjacent to the center region which represent intermediate levels of skill, and a region 10 covering the rest of the surface 9, representing the lowest level of skill. The regions preferably run along the track. When a game piece 3 is located completely within the central region 8, the player may be awarded with the highest performance bonus. As the game piece leaves the central region 8 and enters the intermediate zones of skill 9, the performance bonus decreases fractionally as the game piece moves laterally away from the center of the track. The performance bonus may decrease until the game piece is located completely within the outer region of the track 10, when the performance bonus is at a minimum or no performance bonus is given. Performance may be based upon skill regions of a fixed width or upon a continuous skill function. Those skilled in the art should recognize that the racing track may have obstacles, bonus areas, or other regions which would represent regions of higher or lower skill.

An actuator is preferably adapted to rotate the surface about a central axis on command. The actuator may comprise a stepper motor. A stepper motor preferably facilitates measurement and/or control of how far the surface has rotated about the central axis. Feedback from the stepper motor or other associated device may then be used as input for software calculations. The game piece 3 may be in practically any desired form such as a representation of a car, space ship, horse, dog, or other object. The steering mechanism 4 preferably includes a steering wheel. By steering the steering mechanism, a game player may position his or her game piece substantially within the boundaries of the racing track as the surface rotates about the central axis. The steering wheel is preferably attached to a rod which moves the game piece laterally across the track surface. The steering mechanism position, which translates into the relative lateral position of the game piece, may be picked up by a potentiometer, encoder, or other feedback device. This position may be used as a second input, along with the surface rotation position, for software calculations. The software may calculate the game piece position from the two inputs. The position is then preferably compared to the known position of the track center. Based on the result, instructions are then preferably sent to control the performance indicator. Because performance control is generated by software instead of hardware, game difficulty may be modified by a software program change instead of moving or installing sensors. Games may be programmed to accommodate different skill levels for children or adults.

Figure 3:
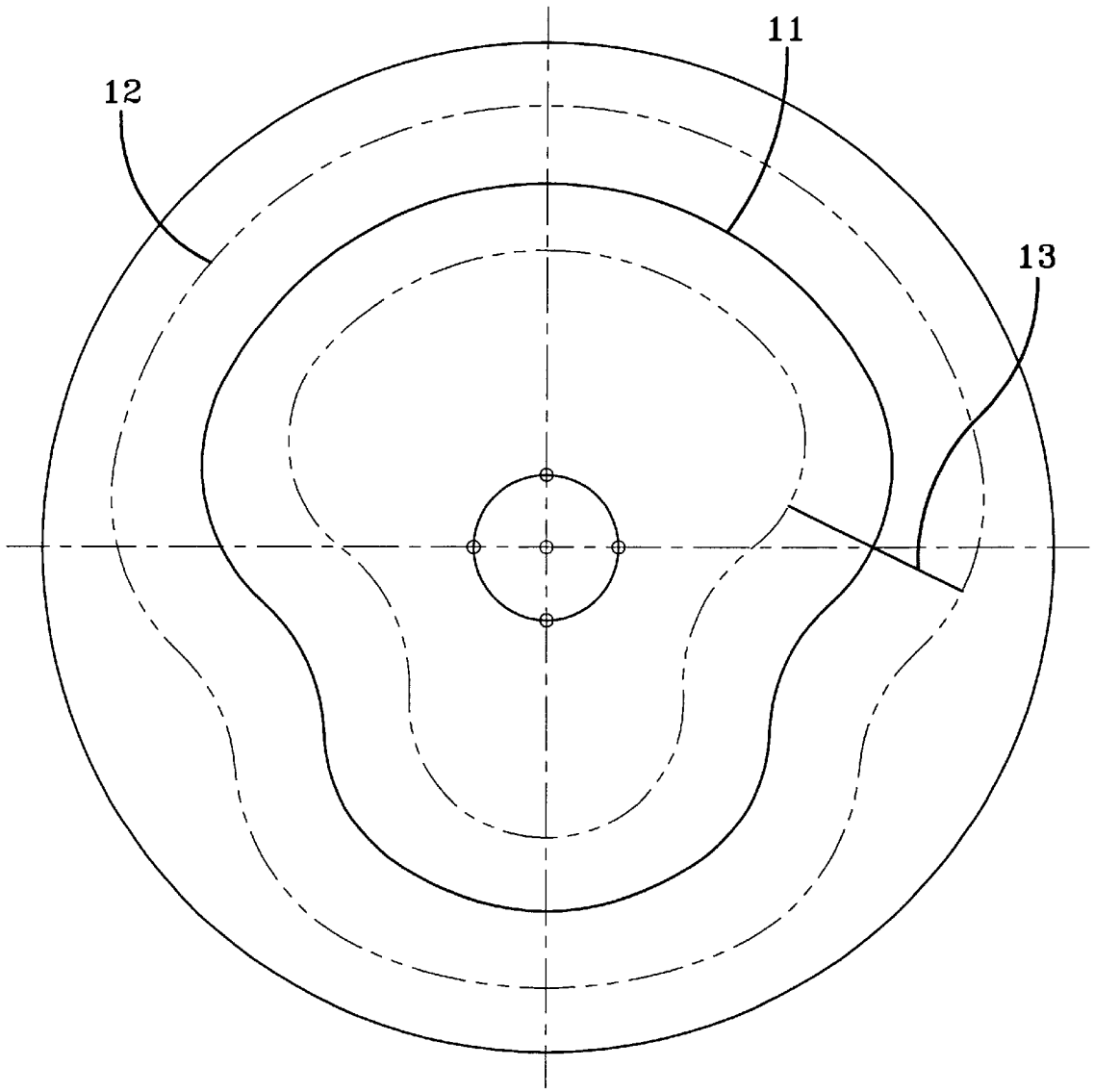
FIG. 3 is a top view of a racing surface in accordance with one embodiment of the present invention.
Figure 4:
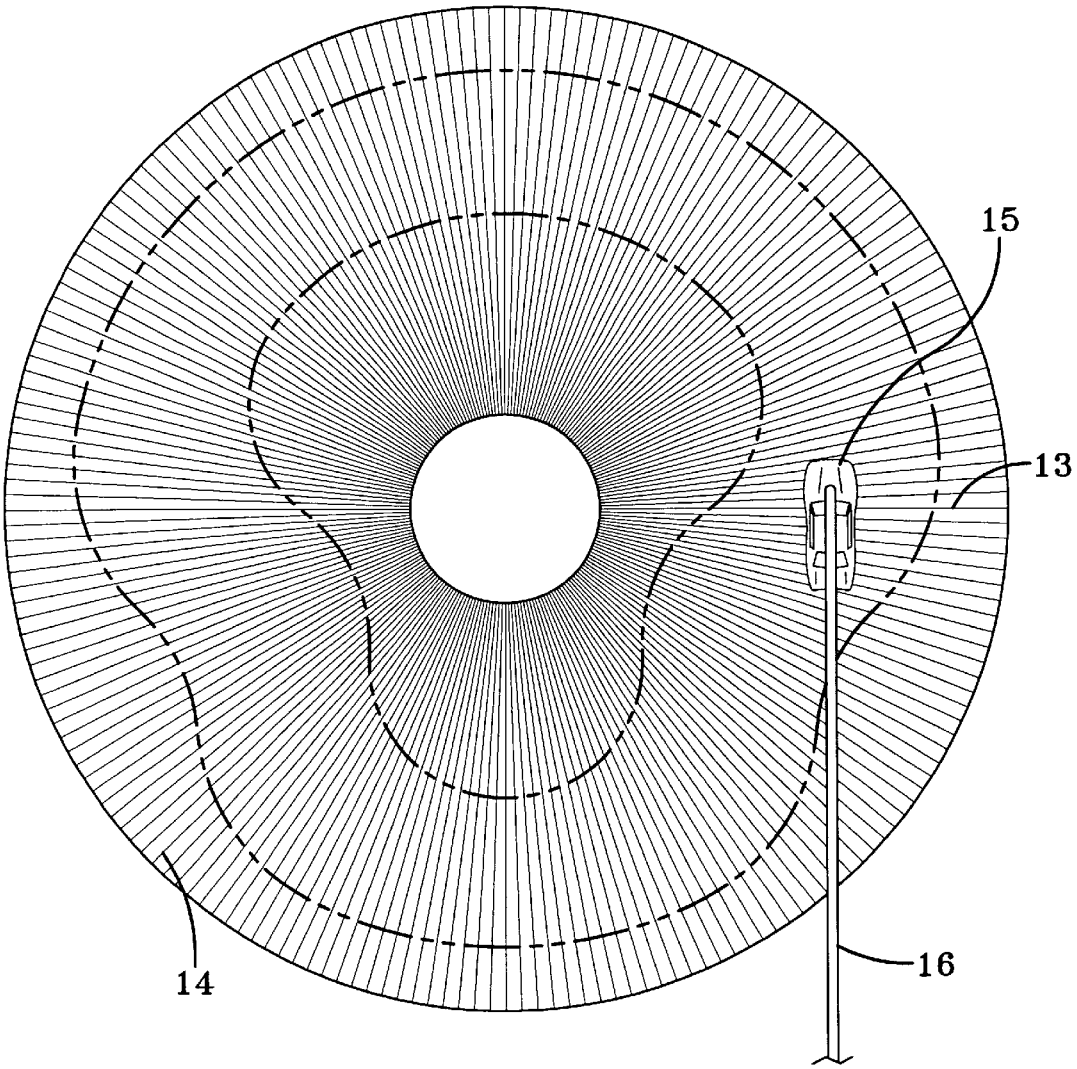
FIG. 4 is second top view of a racing surface in accordance with one embodiment of the present invention.

FIGS. 3 and 4 illustrate top plan views of a track used with one embodiment of a game of the present invention. The outline of the track of FIG. 3 illustrates a centerline 11, start position 13, and boundary 12. FIG. 4 illustrates the same track of FIG. 3, distinguished by a series of lines 14 superimposed over the table or surface. The lines are drawn from the center point, or origin, of the table to the outer edges. These lines 14, or radials, do not appear on the game itself but are used for game programmers.

As the game surface rotates, the motor and game program may constantly track the degrees the surface has rotated. Therefore, the number of degrees the surface has rotated from a start position 13 is tracked and stored. In one embodiment, sensor technology is used to detect the degrees the surface has turned. In an alternate embodiment, a stepper motor is calibrated so that the degrees the surface has turned can be determined from the stepper motor function. The game, via programming, knows by determining how many degrees the surface rotates, which radial 14 is aligned with the fixed starting point 13. In a preferred embodiment, a magnetic sensor attached to an edge of the table is used to return the table to the starting point at the end or start of every race). In FIG. 4 there are 200 radials 14 (the number of radials 14 may be mcreased for greater accuracy.

As an example, assume radial 1 is aligned with the fixed starting point 13. In one embodiment, if the surface rotates 90 degrees, radial 50 would be aligned with the fixed starting point 13. This first coordinate value, or radial value, is one of the coordinates required to locate the relative position of the game piece 15 on the surface of the table.

A second coordinate value is determined by the game piece 15 along its axis as the game piece 15 is moved in the left and right direction, left and right being determined from a reference point facing the steering wheel of the game. The game piece 15 is preferably connected to a connecting rod 16 at a single point. In the preferred embodiment, the rod 16 is attached at the other end to a gear and steering wheel. As the steering wheel rotates, the rod 16 moves the game piece 15 between a left-most position and a right-most position on the game surface. In one embodiment, the rotation of the steering wheel is measured by a sensing device, which is then stored as the second coordinate value (i.e., game piece position value). In another embodiment, game piece position values are determined by connecting the steering mechanism with a potentiometer. By measuring the resistance value or current through the potentiometer, the game can determine the location of the game piece over the game surface. In a preferred embodiment, the game is calibrated to allow the game piece 15 to move in a range of preset values divided into 256 positions from 0 to 255 (more positions can be added for greater accuracy).

The radial and game piece position values or coordinates are determined by the game system and processing equipment as the table surface rotates during game play. These collected values are preferably compared to stored values. In one embodiment of the game, the absolute position of the game piece from 0 to 255 is used. In another embodiment, the lateral distance traveled from a known start position may be used. Accordingly, the table centerline and/or boundary position can be programmed for each radial value.

In operation, the data for determining performance preferably includes the radial value, the centerline position (and/or boundary position) value for that radial, and the game piece position value. As the table surface turns, the radial value is continuously determined. Again looking at FIG. 3, the desired centerline 11 or boundary positions are determined by using the radial value. The actual game piece position value is determined by movement of the steering wheel. The system continuously calculates the difference between a desired position value for each radial value (e.g., centerline position value) and the actual game piece position value. If the difference between the values is small, the game player is maintaining the game piece relatively close to the desired value. Similarly, the game may track when the game piece moves outside the boundary position values for each radial.

As shown in FIG. 1, the game preferably contains a second surface 17 visible from all individual racing games. This surface preferably contains an indicator of progress 5 for each individual racing game. Each indicator of progress 5 may move along an associated path 6 on the surface towards a predetermined destination 7. The rate at which the indicator 5 moves towards its destination 7 preferably depends on the performance of the respective player, with the indicator 5 preferably moving faster when a respective player positions the respective game piece 3 over a region reflecting a higher level of skill, and preferably moving slowly or not at all when the player positions the respective game piece over the region of lowest skill or outside the track boundaries. The rate preferably varies fractionally or continually as the game piece moves from a region of higher skill to a region of lower skill.

Figure 5:
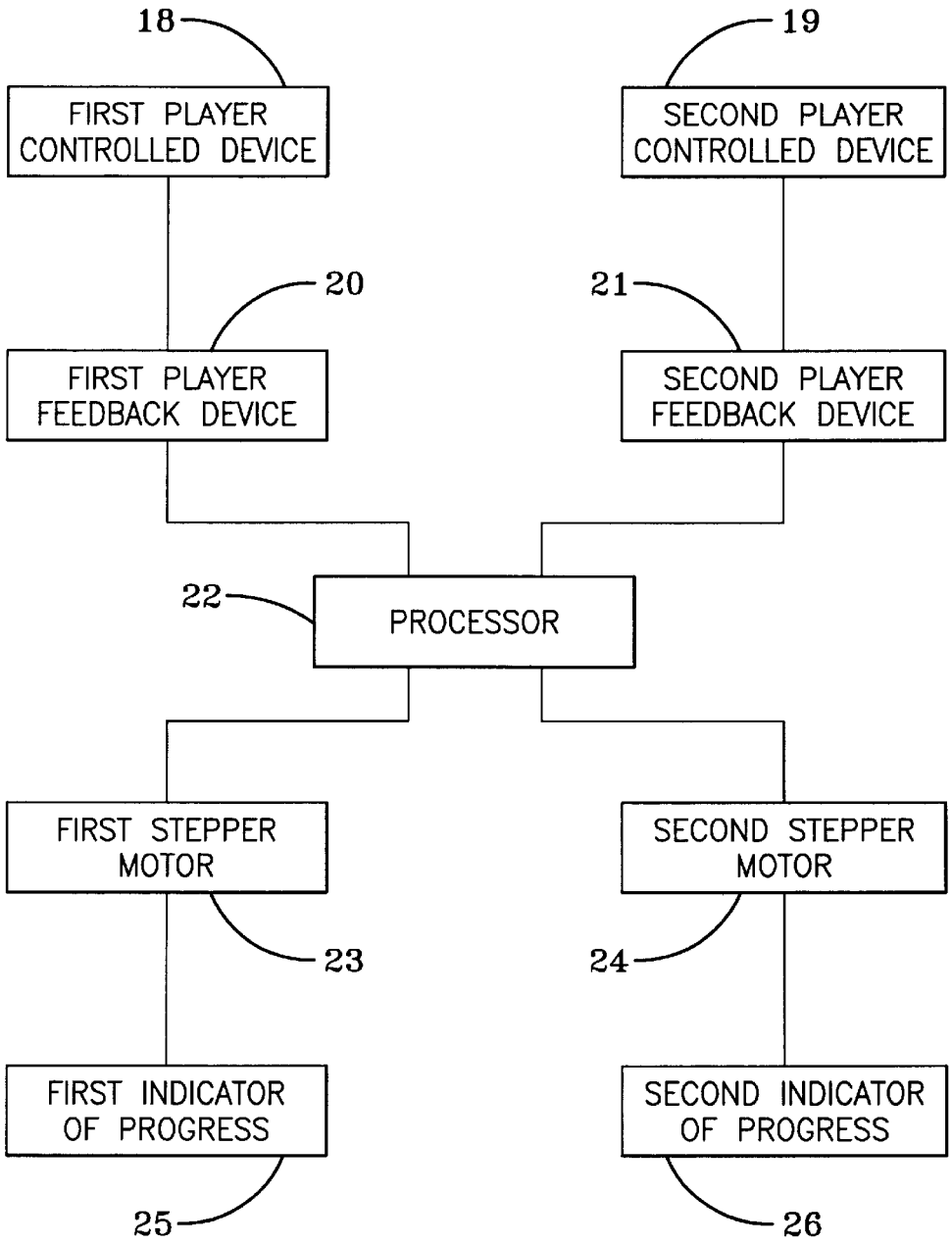
FIG. 5 is a schematic diagram of a competition game of the present invention.

In one possible embodiment shown in FIG. 5, two players compete in a competition game. The first player uses a first player controlled device 18, which is mechanically attached to a first player feedback device 20. The second player uses a second player controlled device 19 mechanically connected to a second player feedback device 21. The feedback devices are preferably adapted to detect fractional performance in a respective individual game. The feedback from these devices is then used as input for a processor 22. The processor, electronically connected to the first player feedback device 20 and second player feedback device 21, analyzes the input signal from each feedback device and makes a determination of performance of each player. For instance, in a racing game the object might be to maintain a game piece as near to the center of a track as possible. The feedback device might send a signal to the processor reflective of the proximity of the game piece to the center of the track. The processor might then make a determination of performance based upon the feedback signal.

The processor 22 in this embodiment then outputs a drive signal for each game, to control the indicators of progress. A first stepper motor 23 or other appropriate drive device is electronically connected to the processor, adapted to receive an electronic signal from the processor. The first stepper motor is connected by a mechanical linkage to a first indicator of progress 25. The first indicator of progress advances along a path at a rate determined by the signal sent by the processor to the first stepper motor. As the performance of a player increases, the signal from the processor preferably indicates that the stepper motor should advance the respective indicator of progress at a more rapid rate.

A second stepper motor 24 is electronically connected to the processor in a similar fashion. The second stepper motor drives by mechanical linkage a second indicator of progress 26. The indicators of progress will then proceed down their respective paths at differing variable rates determined by the processor. The first indicator to reach its destination then preferably signals the winner of the competition game. It is to be understood that this embodiment could also encompass several additional individual games and could use multiple feedback devices per individual game.

As shown in FIG. 2, the game may include award dispensers 27. An award dispenser may be practically any conventional award dispenser known to those of ordinary skill in the art of arcade games. An award dispenser 27 may distribute items such as tickets, coupons, tokens, or other types of prizes or awards. In some embodiments, an award dispenser may only distribute a fixed award regardless of how well or poorly a game player performs. In other embodiments, an award dispenser may distribute awards that vary based on the fractional performance of a game player.

Figure 6:
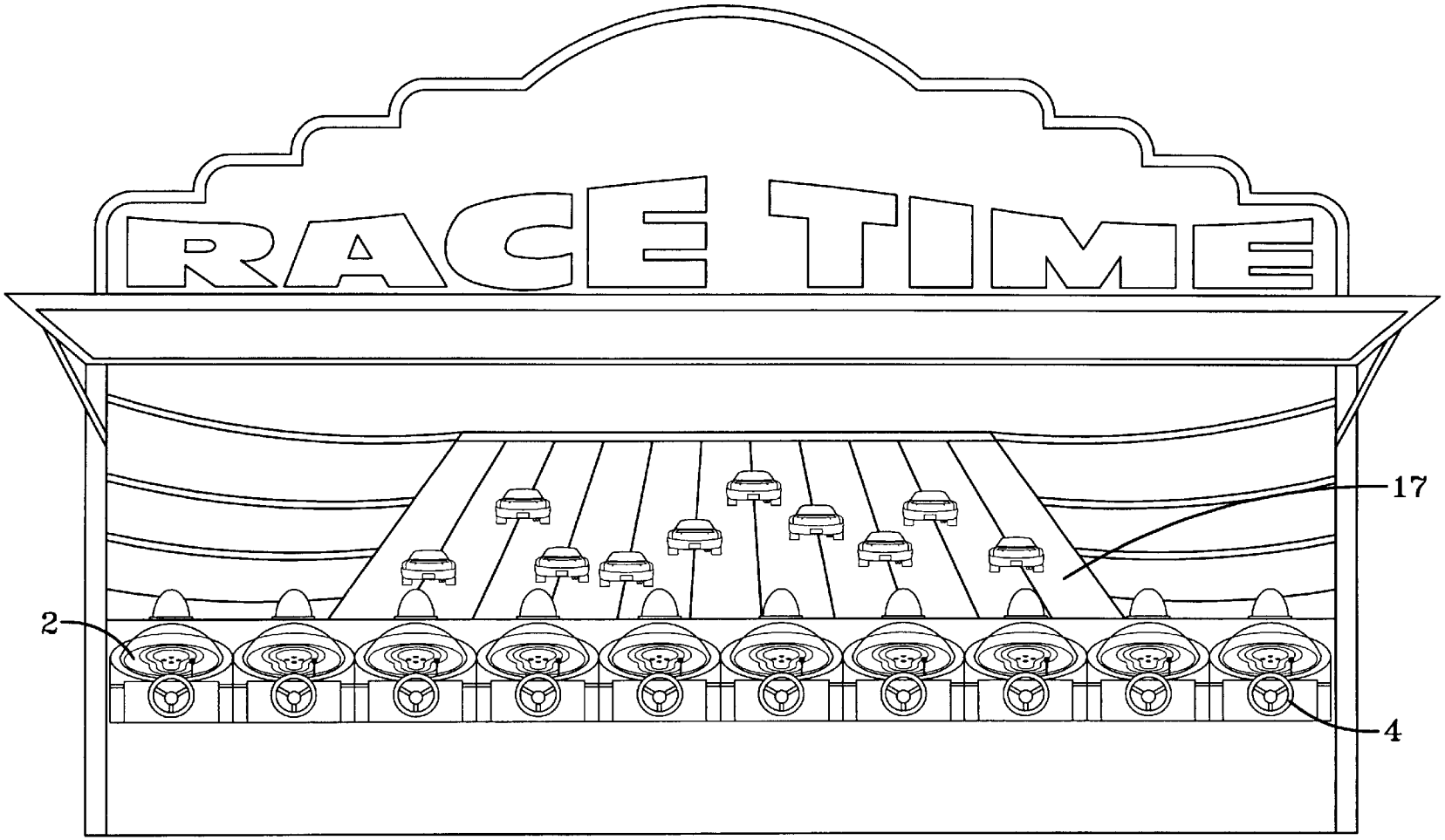
FIG. 6 is an elevational view of a second preferred embodiment of a game of the present invention.
Figure 7:
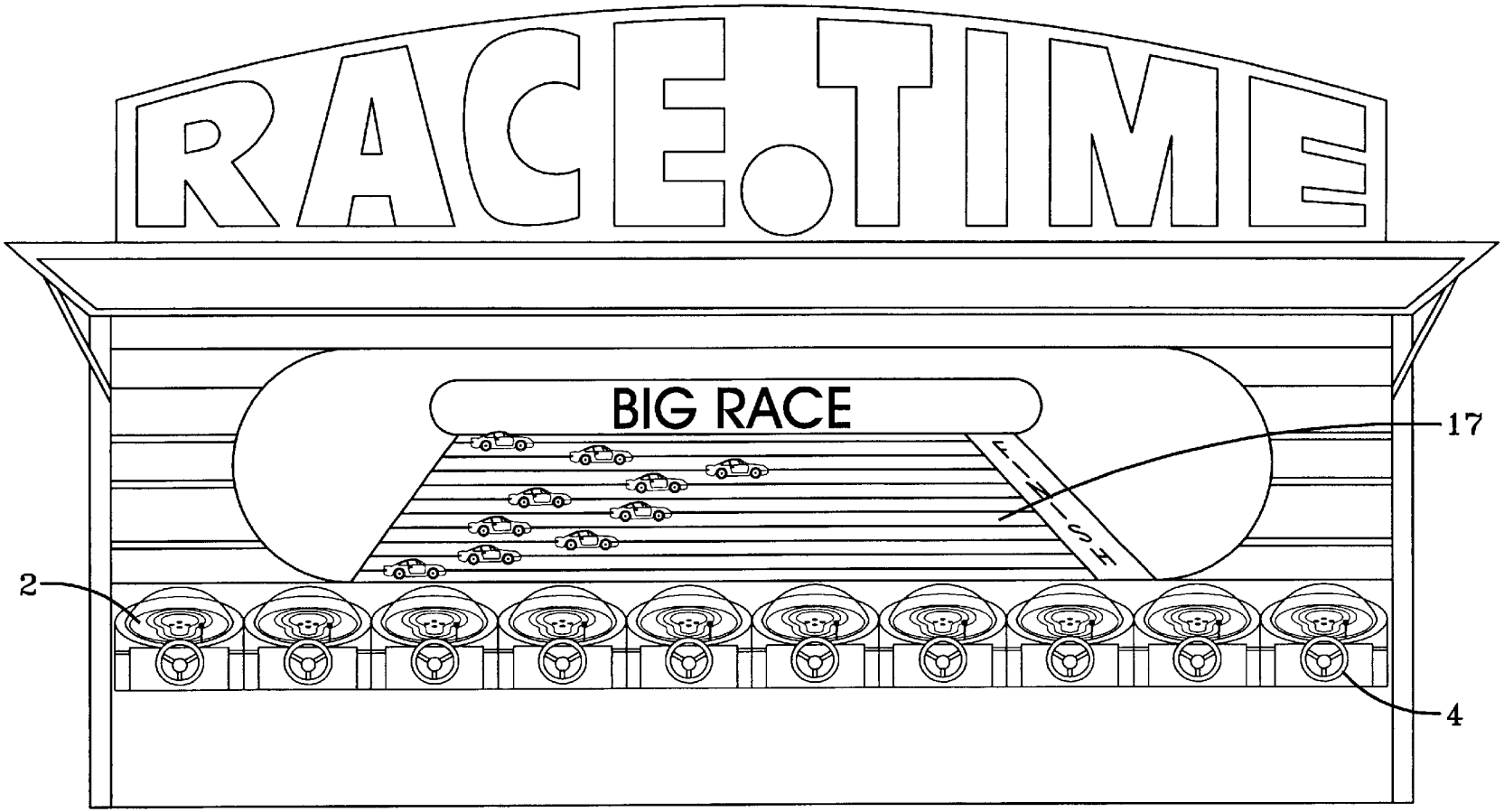
FIG. 7 is an elevational view of a third preferred embodiment of a game of the present invention.
Figure 8:
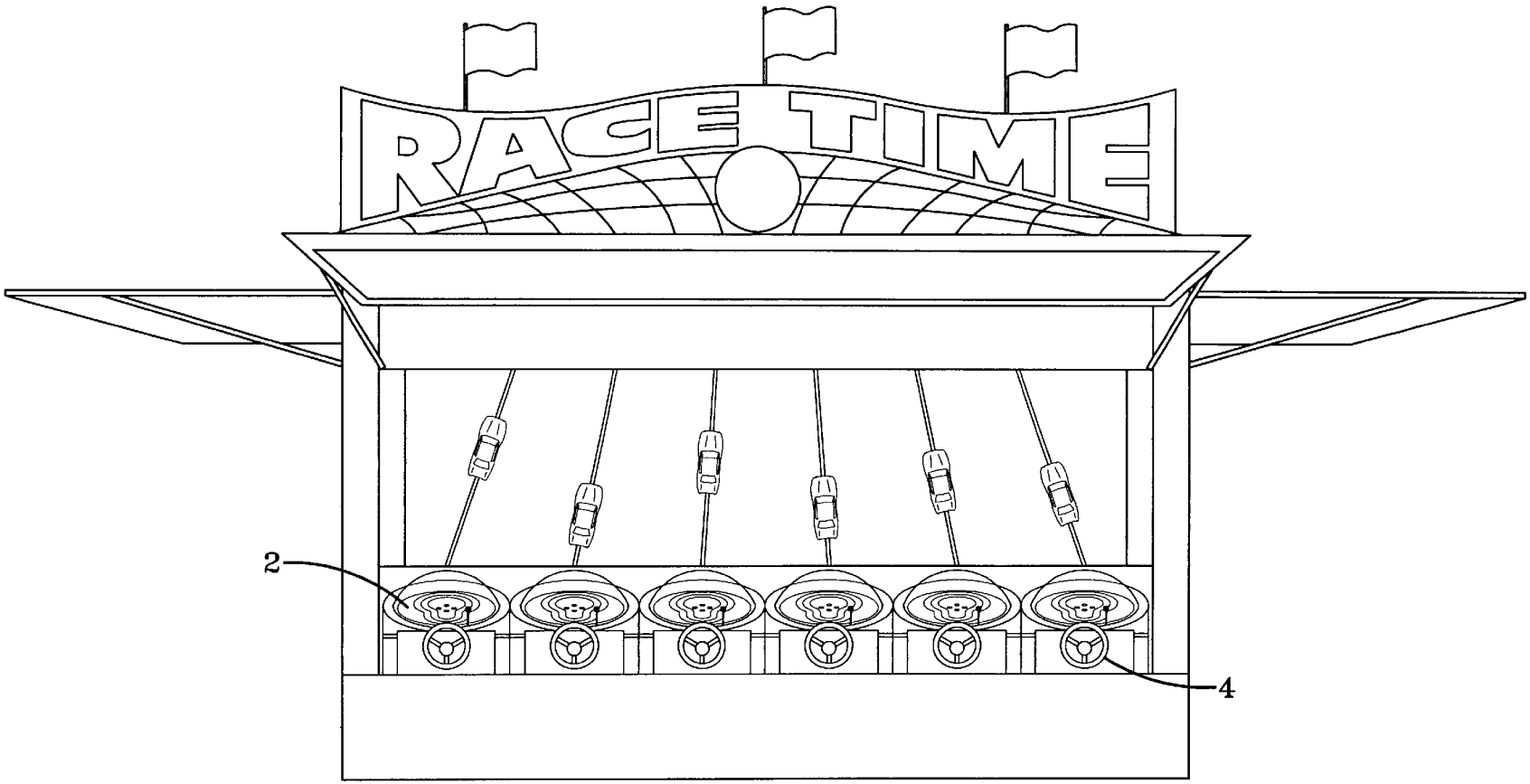
FIG. 8 is an elevational view of a fourth preferred embodiment of a game of the present invention.

The game of the present invention may further include audio and/or visual indications of the progress of a game. For example, audio speakers may be electronically connected to an actuator and a pre-programmed sound card to produce a car crash sound if a player's game piece leaves the track. The game may also produce engine-like sounds that are reflective of a player's fractional performance, such as getting louder or emulating sounds of a higher revving engine. In another embodiment, bright lights may flash when a first player's indicator of progress reaches its predetermined destination. Lights or other visual displays may turn on or may display more brightly as a player's performance increases. Alone or in association with the bright lights, a loud siren may sound indicating that a player's indicia of advancement is the first to reach its destination. FIGS. 6 through 8 show other embodiments of the present invention.

It should be understood that other embodiments of arcade-style games are included in the present invention. In any competition game where indicators of progress are used to display relative performance, variable speeds can be used to more accurately reflect the performance of each player. For example, in a shooting game or game involving throwing balls at a target or basket, more points may be displayed or indicator speed increased the less time that passes between successful shots. This allows a player who might fall behind initially a chance to catch up by increasing the speed or accuracy of his or her shots. In the past, points were awarded for hitting the target alone. Someone who hit the target 20 times in a 2 minute period would be scored the same as someone who hit the target 20 times in a 5 minute period. In the present invention, the player hitting the target 20 times in 2 minutes would receive more points or have an indicator of progress move more quickly than the player who took 5 minutes, due to a better relative performance. This could also apply to games involving hitting moving targets, tossing rings, rolling balls into holes or rings, etc.

In a game where progress is measured by filling a container or compartment with water, sand, or other flowable material, the rate at which the material flows may increase as the performance of a player increases. For example, in a game where a player tries to shoot water at a target, current technology uses a valve that allows water to flow into a container at a constant rate while the player is hitting the target and not at all when a player is not hitting the target. In a game of the present invention, the valve would let in a variable flow of water that is more reflective of the amount of water hitting the target.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A competition game in which one or more players seek to advance indicators of progress, said competition game comprising:

(a) a plurality of individual competition games, wherein a respective each of said individual competition games contains a player-controlled device and a feedback device in communication with said player-controlled device; and (b) a plurality of indicators of progress, each indicator of progress adapted to advance along a path toward a destination at a variable rate of speed determined by the performance of one of said players in a respective said individual competition game, said performance determined by said feedback device.

2. The competition game of claim 1 additionally comprising a processor adapted to receive information of said performance from said feedback device of each of said plurality of individual competition games and send an appropriate drive signal to each corresponding one of said plurality of indicators of progress.

3. The competition game of claim 1 wherein said individual competition game comprises a surface indicating a racing track, a player-controlled game component positioned substantially adjacent to said surface, and a steering mechanism connected to said game component adapted to enable movement of said game component over a region of said surface.

4. The competition game of claim 1 further comprising an award dispenser.

5. The competition game of claim 4 wherein said award dispenser distributes respective awards to respective players, said awards depending on the performance of each respective player.

6. The competition game of claim 1 wherein said game ends when one of said indicators of progress reaches its respective destination.

7. A competition game in which one or more players seek to advance indicators of progress, said competition game comprising:

(a) a plurality of surfaces, each of said surfaces having a racing track depicted thereon;

(b) a plurality of actuators, each of said actuators adapted to rotate a respective one of said surfaces about a respective central axis on command;

(c) a plurality of first feedback devices, each of said first feedback devices in communication with a respective one of said actuators and adapted to determine the rotational position of a respective one of said surfaces;

(d) a plurality of game pieces, each game piece positioned substantially adjacent to a respective one of said surfaces;

(e) a plurality of steering mechanisms, each said steering mechanism connected to a respective one of said game pieces, each said steering mechanism adapted to move a respective one of said game pieces a predetermined range;

(f) a plurality of second feedback devices, each of said second feedback devices in communication with a respective one of said steering mechanisms and adapted to determine the lateral position of a respective one of said game pieces relative to a respective one of said surfaces;

(g) at least one processor adapted to receive signals from said plurality of first feedback devices and said plurality of second feedback devices and make a determination of performance of each of said players; and (h) a plurality of indicators of progress, each of said indicators of progress adapted to advance along a respective path on a secondary monitor at a variable rate, said variable rate determined by said at least one processor.

8. The competition game of claim 7 further comprising a plurality of award dispensers, each of said dispensers adapted to dispense a respective award to a respective one of said game players.

9. The competition game of claim 8 wherein each of said award dispensers distributes awards that vary based on the performance of a respective game player.

10. The game of claim 7 wherein said game ends when one of said indicators of progress reaches its respective predetermined destination.

11. A game in which one or more players seek to advance indicators of progress, said game comprising:

(a) at least one player-controlled game piece;

(b) at least one feedback device for determining a position of said at least one player-controlled game piece;

(c) at least one indicator of progress adapted to advance along a path toward a destination at a variable rate of speed, the rate of speed of said indicator of progress determined by the performance of a player of said game, said performance determined by use of data obtained from said feedback device.

12. A game according to claim 11, further comprising:

a surface indicating a race track; and wherein said performance is determined by the location of said player-controlled game piece in relation to predetermined areas of said game surface.

* * * * *